United States Patent [19]

Matsuo

[11] 4,241,910

[45] Dec. 30, 1980

[54] SHEET DELIVERING APPARATUS

[76] Inventor: Masaharu Matsuo, 17-3, Higashi-Komagata, 3-chome, Sumida-ku, Tokyo, Japan

[21] Appl. No.: 33,688

[22] Filed: Apr. 26, 1979

[30] Foreign Application Priority Data

Apr. 30, 1978 [JP] Japan ..... 53/051186

[51] Int. Cl.[3] ..... B65H 29/20; B65H 29/16; B65H 29/66

[52] U.S. Cl. ..... 271/202; 83/107; 83/110; 15/77; 271/216; 271/299; 271/314

[58] Field of Search ..... 271/299, 314, 202, 203, 271/198, 216, 69; 83/88, 89, 107, 110; 198/836, 458, 461; 15/77, 21 D

[56] References Cited

U.S. PATENT DOCUMENTS

| | | | |
|---|---|---|---|
| 2,682,208 | 6/1954 | Monroe et al. | 83/88 X |
| 3,117,333 | 1/1964 | Murray et al. | 15/77 X |
| 3,410,183 | 11/1968 | Sarka | 271/198 X |
| 3,938,674 | 2/1976 | Kroeze et al. | 271/69 X |

FOREIGN PATENT DOCUMENTS

| | | | |
|---|---|---|---|
| 763013 | 12/1956 | United Kingdom | 198/836 |

*Primary Examiner*—Bruce H. Stoner, Jr.
*Attorney, Agent, or Firm*—Toren, McGeady and Stanger

[57] ABSTRACT

Apparatus for receiving sheets of corrugated paperboard or the like from a processing machine such as a slotter for transfer to another device such as a stacker including shifter rollers for longitudinal separation of each sheet, an inclinable belt conveyor for lateral separation of the sheet, and a belt conveyor adapted to be transiently stopped for the accumulation of the sheets, each conveyor having serial rolls along the upper surface of the conveyor belt to pass and restrain the sheets on the conveyor belt. Sheets divided in the slotter are separated crosswise and accumulated in order in the apparatus in accordance with the needs of the succeeding device.

9 Claims, 6 Drawing Figures

SHEET DELIVERING APPARATUS

BACKGROUND OF THE INVENTION

The present invention relates generally to sheet delivering apparatus, and more specifically to apparatus for receiving sheets of corrugated paperboard or the like from a processing machine such as a printer-slotter and to transferring the sheets to another device such as a stacker. The invention relates more particularly to a device for effecting crosswise division of such sheets in the delivery thereof to the processing machine.

Known apparatus interposed between a processing machine and a succeeding device is usually no more than an ordinary belt conveyor. Such apparatus receives sheets permanently discharged from the machine, but is periodically stopped as may fit the needs of the succeeding device, for example, when a full stacker is exchanged for an empty one. The belt conveyor receives the sheets transferred from the continuously running machine and a disorderly overlapping on the stationary conveyor belt will occur. This leads to disadvantages in that the disordered reserved or accumulated sheets on the conveyor belt require labor and time to be rearranged before restarting the conveyor to avoid problems in the succeeding device. Another disadvantage is that, when a sheet is divided in the machine, precise separation, particularly longitudinal separation can not be achieved in the known apparatus with the result that a troublesome manual operation is needed for longitudinal separation of each sheet.

It is the primary object of this invention to provide an improved delivering apparatus in which sheets are temporarily reserved or accumulated in order and precisely separated, if required, while being conveyed from a processing machine to another device.

SUMMARY OF THE INVENTION

With this and other objects in view, as will hereinafter become apparent, the invention provides a drawing roll means, first and second belt conveying means disposed in series in the direction in which sheets are delivered. The drawing roll means is connected to the discharge portion of a processing machine and provided with top and bottom rolls. The top roll is freely rotatable and rearwardly eccentric to the bottom roll, which is rotated at a peripheral speed higher than that of sheet discharge of the machine. The top and bottom rolls discharge each sheet slightly upwardly with acceleration in order to effect a longitudinal separation of sheet. A pair of brush rolls are preferably disposed prior to the drawing rolls to eliminate wastes from each sheet. The first and second conveying means include frames, conveyor belts movably mounted on the frames, and retaining means attached to their entrance gates on the frames to extend along the upper surface of the conveyor belts. The retaining means includes a series of parallel links successively rotatably connected and a series of rolls rotatably mounted in the links, the initial roll and link being adjustably rotatably mounted on the gate above the back portion of the conveyor belts. Each sheet is pressed against the conveyor belt and steadily retained by the serial rolls of the retaining means, while being transported by the conveying means. The conveyor belt in the first conveying means may be laterally inclined and permanently moved. The entrance gate in the first conveying means is adjustably mounted on the frame so as to align the serial rolls and links with the obliquely trained conveyor belt. The lateral separation of sheet is precisely performed when the conveyor belt and the serial rolls are forwardly widely inclined. The conveyor belt in the second conveying means is always parallel to the direction of sheet delivery and stopped in accordance with the needs of the succeeding device. Meantime, the sheets successively transferred from the first conveying means as well as those remaining on the second conveying means are subjected to a retaining action of the serial rolls and are reserved or accumulated in an orderly manner on the conveyor belt.

The various features of novelty which characterize the invention are pointed out with particularity in the claims annexed to and forming a part of this disclosure. For a better understanding of the invention, its operating advantages and specific objects attained by its use, reference should be had to the accompanying drawings and descriptive matter in which three are illustrated and described preferred embodiments of the invention.

DETAILED DESCRIPTION OF THE PREFERRED EMBODIMENTS

Figure 1:
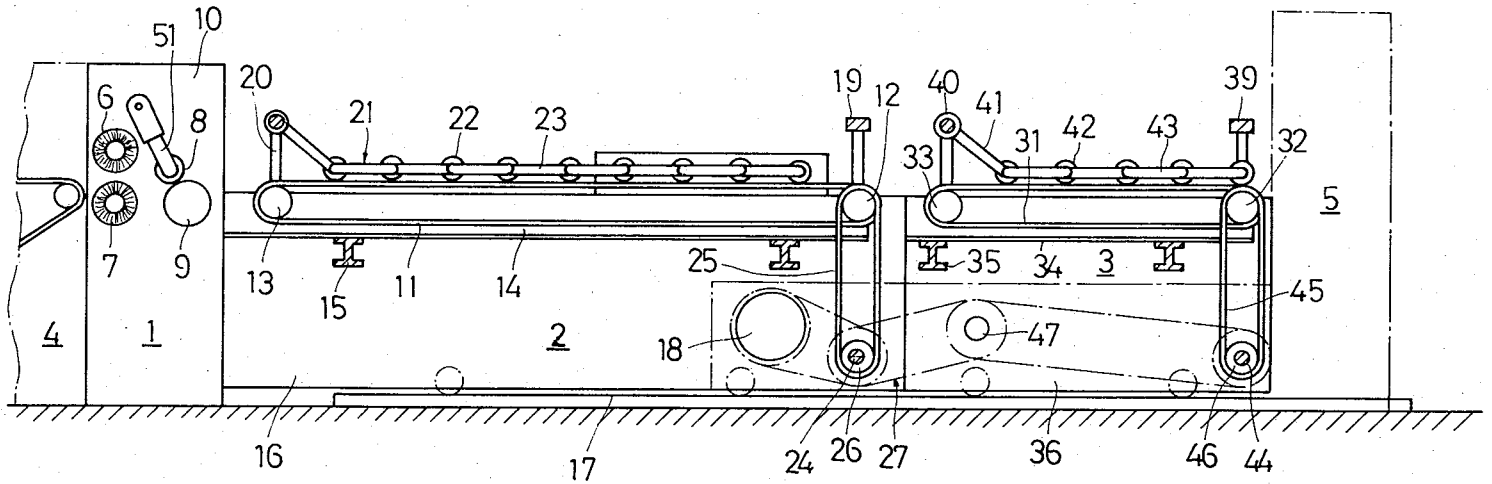
FIG. 1 shows the principal operating elements of a sheet delivering apparatus of the invention in simplified side sectional elevation.

Referring to FIG. 1, there is shown the apparatus of the invention provided with a roller device 1, and first and second conveyor devices 2, 3 and interposed between a slotting machine 4 and a wheeled stacker 5. The roller device 1 is directly connected to the discharge portion of the machine 4 and provided with top and bottom brush rolls 6, 7 and top bottom drawing rolls 8, 9. The top and bottom brush rolls 6, 7 and the bottom drawing roll 9 are rotatably mounted in the frame 10 of the device 1. A driving transmission (not shown) is provided for rotating the brush rolls 6, 7 contrary to the direction of sheet delivery and the bottom roll 9 at a peripheral speed higher than the delivery speed of the machine 4. The top drawing roll 8 is rotatably supported by paired lengthwise adjustable arms 51, which are swingably mounted on the frame 10. The top roll 8 is arranged to be rearwardly eccentric to the bottom roll 9.

The first conveyor device 2 has a conveyor belt 11 trained over front and back pulleys 12, 13 which are rotatably mounted on a beam 14. The beam 14 is adjustably secured to cross rails 15, both ends of which are fixed to a frame 16. The frame 16 is wheeled and movable on a common rail 17. Front and back gates 19, 20 located above the front and back pulleys 12, 13 are supported by the frame 16. A retainer 21 has a series of rolls 22 and links 23 extending from the back gate 20 along the upper surface of the conveyor belt 11, the rolls 22 having a diameter larger than the height of the link 23.

The second conveyor device 3 has a conveyor belt 31 trained over front and back pulleys 32, 33 rotatably mounted on a beam 34. The beam 34 is adjustably secured to cross rails 35, both ends of which are fixed to a frame 36, which is wheeled and movable on the common rail 17. The front and back gates 39, 40 are mounted on the frame 36 above the front and back pulleys 32, 33, respectively. A retainer 41 has a series of rolls 42 and links 43 extending from the back gate 40 along the upper surface of the conveyor belt 31 toward the front gate 39.

First and second driving shafts 24, 44 under the front pulleys 12, 32 are rotatably supported by the side frames 16, 36, respectively. First and second transmitting belts 25, 45 are trained over the respective front pulleys 12, 32 and under pulleys 26, 46 fixed to the resepctive shafts 24, 44. The first and second driving shafts 24, 44 are driven by a motor 18 through the intermediary of a transmission 27. The transmission 27 has a clutch 47 for stopping the second driving shaft 44 irrespective of the first driving shaft 24, which is permanently rotated in synchronism with the machine 4.

Figure 2:
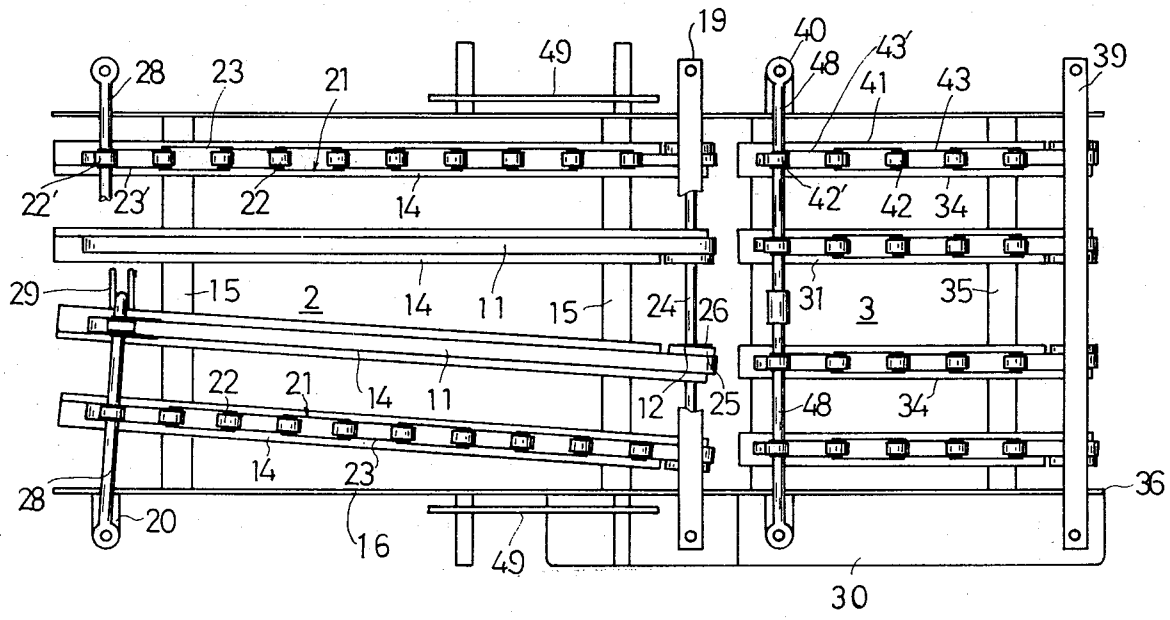
FIG. 2 illustrates the apparatus of FIG. 1 in top plan view.

Referring to FIG. 2, there are seen two straight and two inclined beams 14 in the first conveyor device 2, in order to show that the beam 14 together with the conveyor belt 11 may be laterally inclined or skewed. The beams 14 are symmetrically secured to the cross rails 15, being parallel to the direction of sheet delivery unless lateral separation of sheet is needed but forwardly widely inclined when the separation is required. The distance of beams 14 is determined in conformity with the width of sheet to be delivered.

Opposite gate bars 28 have their outer ends rotatably mounted on the back gate 20 and the inner ends adjustably connected to each other with the intervention of a bored rod 29. The retainer 21 has its initial roll 22' and link 23' adjustably, rotatably mounted on the gate bar 28 and the succeeding links 23 rotatably jointed one by one to form a series of links, in each jointed portion of which a roll 22 is rotatably mounted. The under pulley 26 is adjustably secured to the first driving shaft 24 and usually arranged to locate just under the front pulley 12. When the conveyor belt 11 is inclined with the beam 14, the gate bar 28 and the initial roll 22' and link 23' are arranged to have the serial rolls 22 aligned with the upper surface of the inclined belt 11. It will be understood that the transmitting belt 25 is slightly twisted without causing inconvenience in transmission. The right and left lateral guides 49 are provided on the front half of the frame.

The second conveyor device 3 has four parallel conveyor belts 31 supported by the four respective beams 34, which are adjustably secured to the cross rails 35. The retainer 41 has the initial roll 42' and link 43' adjustably, rotatably mounted on the bar 48 of the gate 40. The succeeding links 43 are rotatably jointed one by one to form a chain of links in each joint of which a roll 42 is rotatably mounted. The serial rolls 42 and links 43 are aligned with the upper stand of the respective conveyor belts 31.

The forward end of the retainers 21, 41 can be connected to the front gate 19, 39, respectively, by the use of a joint (not shown) if needed. A common housing 30 is provided on one side of both frames 16, 36 for containing the driving transmission of the conveyor devices.

Figure 3:
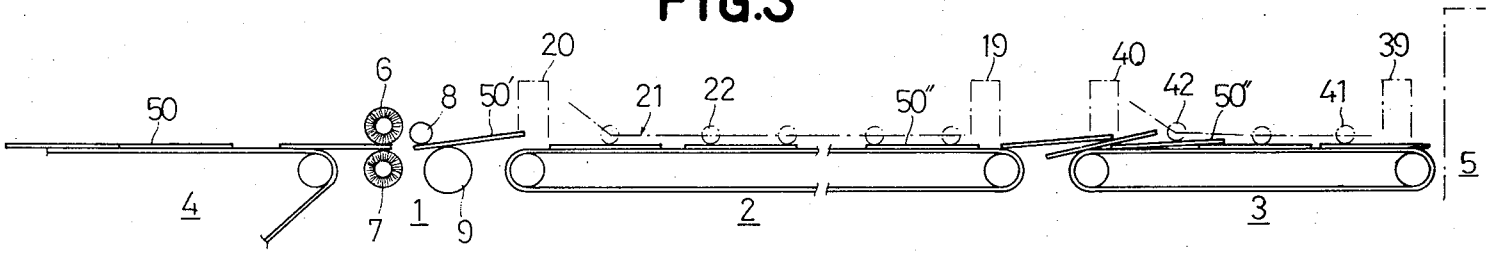
FIGS. 3 and 4 are schematic side and top plan views for illustration of manner of delivery in which sheets are separated crosswise and reserved.
Figure 4:
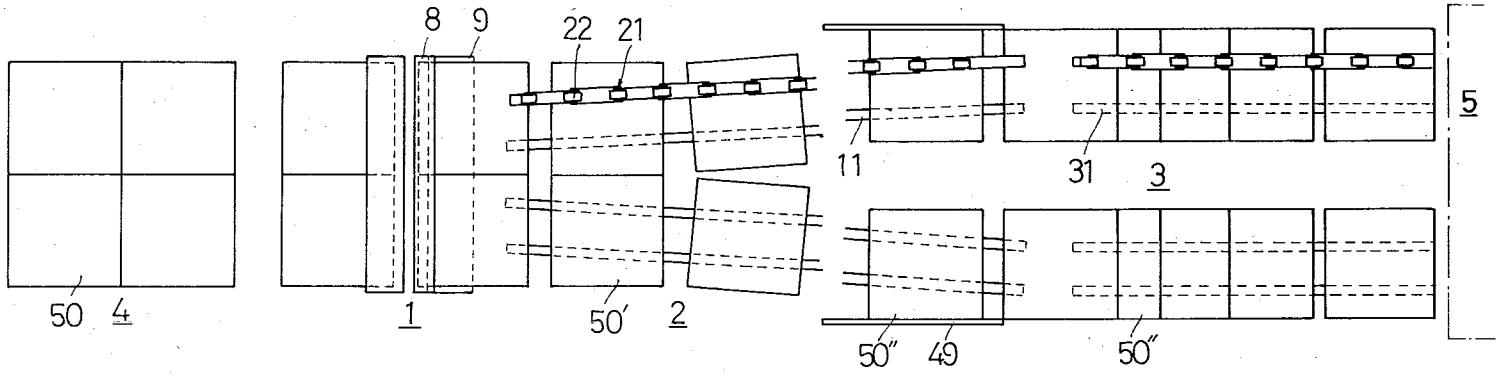

The manner of operation of the apparatus will now be explained particularly with reference to the schematic views in FIGS. 3 and 4. A sheet 50 is divided into four pieces in the machine 4 and then transferred to the roller device 1, in which firstly the brush rolls 6, 7 eliminate projecting wastes from the sheet 50 without touching its obverse and reverse surfaces. When the sheet 50 is nipped by the drawing rolls 8, 9 in the roller device 1, it has its forward portion slightly raised and the rear portion slightly lowered due to a rearward eccentricity of the top roll 8 relative to the bottom roll 9. Accordingly, the sheet as longitudinally divided in the machine 4 undergoes a shearing action of stagger rolls 8, 9 to have its forward half perfectly separated from the rearward half. The longitudinally separated sheet 50' is accelerated and discharged slightly obliquely upwardly to the first conveyor device 2 by the bottom roll 9, which is turning at the higher speed than the delivery speed of the machine 4.

The laterally imperfectly separated sheet 50' goes through a gap under the gate 20 onto the forwardly widened conveyor belts 11. The sheets 50', while being conveyed from the back gate 20 toward the front gate 19, is pressed against the inclined belts 11 and steadily retained by the serial rolls 22 of the retainer 21. The serial rolls 22 make a rolling contact with the upper surface of the sheet 50' without imparting any frictional damage to the sheet. The right and left pieces of the sheet 50', while being carried along the forwardly widened belts 11, are oppositely inclined and completely separated from each other. The inclined pieces have their side edges guided by the lateral guides 49 and their travel direction is rectified to be in alignment with the direction of sheet delivery prior to being delivered through a gap under the front gate 19 to the second conveyor device 3.

Thereafter, the longitudinally, laterally perfectly separated sheet 50'' passes through a gap under the back gate 40 onto the parallel conveyor belts 31, in which it is retained by the serial rolls 42 of the retainer 41 as in the first conveyor device 2. Each sheet is transported to the front gate 39, in which it is transferred to the stacker 5.

The second conveyor device 3 receives the sheets permanently from the continuously running conveyor device 2, even when it is temporarily stopped for replacement of a full stacker to an empty one. The sheets transferred from the first conveyor device 2 are partly overlapped on the transiently stationary conveyor belts 31, giving a further thrust to the sheets already contained on the conveyor belts 31. With the assistance of the retainer 41, however, these sheets are prevented from being displaced out of order and they are regularly reserved on the conveyor belts 31 during the stoppage of the conveyor belts. When the second conveyor 3 restarts, the accumulated sheets do not require an operation to be rearranged and they are delivered to the stacker 5 in order.

Figure 5:
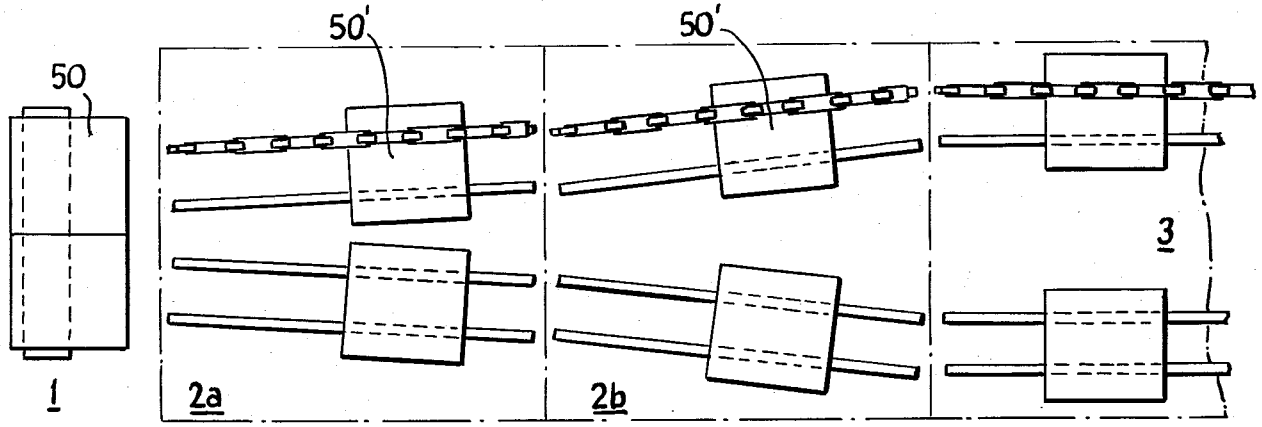
FIGS. 5 and 6 are top plan views of alternate embodiments of the invention.
Figure 6:
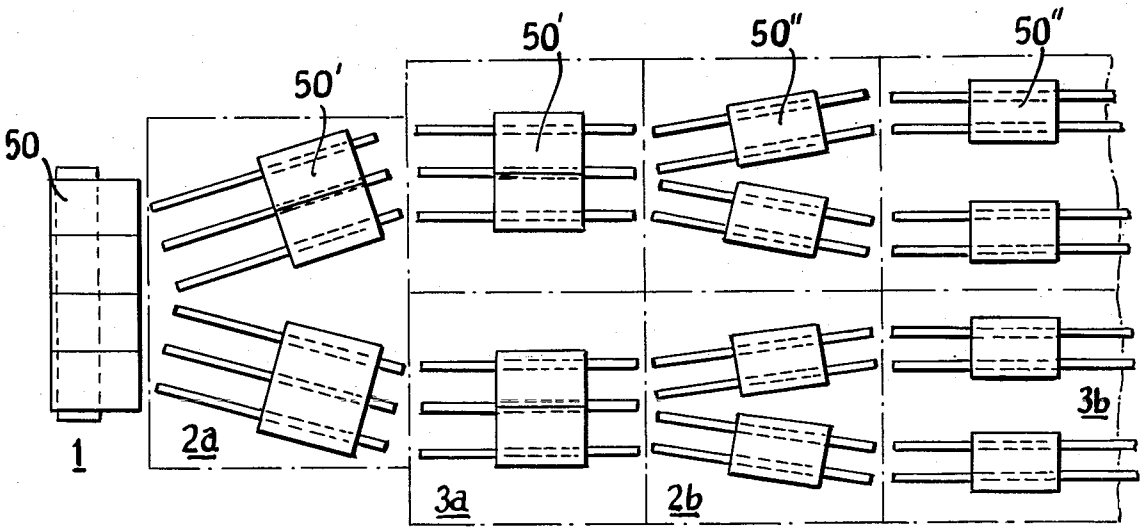

From the foregoing it will be seen that the apparatus of the invention, while conveying sheets from a processing machine to another device, can separate the sheets crosswise and reserve them in order temporarily without requiring additional operations. It will be understood that, with reference to FIGS. 5 and 6, if a sheet is laterally divided into three or more parts, two or more first conveyor devices **2*a* of 2*b* of the type having inclinable belts are disposed directly in series or interconnected by a second conveyor device 3*a* or 3*b* of the type having parallel belts. For example, with reference to FIG. 5, it will be seen that a sheet 50 is divided only into two parts 50' which are separated from each other by serially arranged first conveying means 2*a*, 2*b*. In FIG. 6, a sheet 50 is first divided into two intermediate parts 50' in the rearward first conveying means 2a with the parts 50' being straightened in the rearward second conveying means 3a. Each intermediate part 50' is then further divided into two final parts 50'' in the front first conveying means 2b with the final parts 50'' being straightened in the front second conveying means 3b**.

It should be understood, therefore, that the foregoing disclosure relates only to presently preferred embodiments, and that it is intended to cover all changes and modifications of the examples of the invention herein chosen for the purpose of the disclosure which do not constitute departures from the spirit and scope of the invention set forth in the appended claims.

While specific embodiments of the invention has been shown and described in detail to illustrate the application of the inventive principles, it will be understood that the invention may be embodied otherwise without departing from such principles.

What is claimed is:

1. Sheet delivering apparatus for transporting sheets from a processing maching to another device comprising:

support means:

roller means mounted on said support means for longitudinal separation of said sheets;

said roller means including top and bottom rolls, said top roll being rotatably supported at a location rearwardly eccentric relative to said bottom roll, said bottom roll being driven to rotate at a peripheral speed higher than the speed of sheet delivery of said processing machine;

first conveying means for lateral separation of said sheets, said first conveying means including paired first conveyor belts forwardly successional relative to said bottom roll, said first conveyor belts being supported by said support means to be movably laterally adjustable;

first retaining means adjustably mounted on said support means having a series of rolls and links extending forwardly along the upper surface of said first conveyor belts;

first driving means for continuously moving said first conveyor belts in synchronism with said processing machine;

second conveying means for temporary accumulation of sheets, said second conveying means including paired second conveyor belts forwardly successional to said first conveyor belts and supported by said support means to be movably laterally adjustable;

second retaining means adjustably mounted on said support means and having serial links and rolls extending forwardly along the upper surface of said second conveyor belt; and second driving means for selectively moving said second conveyor belt in synchronism with said first conveyor belt and for stopping said second conveyor belt irrespective of said first conveyor belt.

2. Apparatus according to claim 1, wherein said top roll is rotatably supported by paired lengthwise adjustable arms swingably mounted on said support means.

3. Apparatus according to claim 1, wherein said roller means includes at least a brush roll rotating contrary to the direction of sheet delivery, said brush roll being so disposed as to eliminate projected wastes from a sheet without making direct contact with the surface of said sheet.

4. Apparatus according to claim 1, wherein said first conveyor belts include at least one pair of conveyor belts movably mounted on a beam laterally adjustable and inclinably secured to said support means.

5. Apparatus according to claim 1, wherein said first conveying means includes a first gate mounted on said support means above a back portion of said first conveyor belts, said first retaining means having its initial roll and link rotatably attached to said first gate, each roll being rotatably mounted in the respective connected portions of two adjacent links.

6. Apparatus according to claim 5, wherein said second conveying means includes a second gate mounted on said support means above a back portion of said second conveyor belts, said second retaining means having an initial roll and link rotatably attached to said second gate, each roll being rotatably mounted in the respective connected portions of two adjacent links.

7. Apparatus according to claim 6, wherein said first and second gates are inclinably adjustably disposed on said support means.

8. Apparatus according to claim 1, wherein a plurality of said first conveying means are serially disposed.

9. Apparatus according to claim 8, wherein another second conveying means is interposed between two of said first conveying means.

* * * * *